US007731318B2

(12) United States Patent
Liu et al.

(10) Patent No.: US 7,731,318 B2
(45) Date of Patent: Jun. 8, 2010

(54) PNEUMATIC INK-JET SYSTEM

(75) Inventors: Chi-Shi Liu, Sijhih (TW); Chih-Yi Lai, Sijhih (TW); Chun-Ying Cheng, Sijhih (TW)

(73) Assignee: Digital Photonics Corporation, Sijhih, Taipei Hsien (TW)

( * ) Notice: Subject to any disclaimer, the term of this patent is extended or adjusted under 35 U.S.C. 154(b) by 339 days.

(21) Appl. No.: 12/039,568

(22) Filed: Feb. 28, 2008

(65) Prior Publication Data

US 2009/0219350 A1 Sep. 3, 2009

(51) Int. Cl.
*B41J 29/38* (2006.01)

(52) U.S. Cl. ..... 347/5; 347/6; 347/84

(58) Field of Classification Search ..... 347/5–7, 347/84–86

See application file for complete search history.

(56) References Cited

U.S. PATENT DOCUMENTS

| | | | | |
|---|---|---|---|---|
| 5,619,238 | A * | 4/1997 | Higuma et al. | 347/86 |
| 6,302,516 | B1 * | 10/2001 | Brooks et al. | 347/35 |
| 6,543,877 | B1 * | 4/2003 | Boutet et al. | 347/30 |
| 2002/0097284 | A1 | 7/2002 | Vosahlo | |

* cited by examiner

*Primary Examiner*—Lamson D Nguyen
(74) *Attorney, Agent, or Firm*—patenttm.us

(57) ABSTRACT

A pneumatic ink-jet system is applied in an inkjet printer and uses a negative pressure generator, which is designed according to the Bernoulli's Theory, with a stable airflow in a certain speed to generated stable pressure inside at least one inkpot and at least one print head. Therefore, the at least one print head is kept in an appropriate wet state and the quality of printing is enhanced. Moreover, a top surface of the ink inside the at least one inkpot can be controlled to be higher than the at least one print head, so the pneumatic ink-jet system can be applied in a large format inkjet printer.

12 Claims, 2 Drawing Sheets

PNEUMATIC INK-JET SYSTEM

BACKGROUND OF THE INVENTION

1. Field of Invention

The present invention relates to an ink-jet system, and more particularly to a pneumatic ink-jet system, which provides stable air pressure to jet ink while printing.

2. Description of the Related Art

A conventional pneumatic ink-jet system is applied in an inkjet printer to control ink to be released from an inkpot through a print head while operating the inkjet printer. An air pump is used in the conventional pneumatic ink-jet system to directly control pressure inside the inkpot such that quantity of ink in the print head maintains appropriate to keep the print head in a wet state.

However, pressure generated by the air pump is usually unstable as shown in FIG. 3 because the air pump vibrates all the time. The unstableness of the pressure generated by the air pump may lead the print head to be over-wet or too dry, such that the quality of printing is influenced badly.

Moreover, in the conventional pneumatic ink-jet system, the surface of the ink inside the inkpot is higher than the position the print head. That is a good method to help control the pressure inside the inkpot but only for normal, standard prints. The method can not be applied in a large format inkjet printer.

To overcome the shortcomings, the present invention provides a pneumatic ink-jet system to mitigate or obviate the aforementioned problems.

SUMMARY OF THE INVENTION

The primary objective of the present invention is to provide a pneumatic ink-jet system, which provides stable pressure to enhance quality of an inkjet printer.

The pneumatic ink-jet system is applied in an inkjet printer and uses a negative pressure generator, which is designed according to the Bernoulli's Theory, with a stable airflow in a certain speed to generated stable pressure inside at least one inkpot and at least one print head. Therefore, the at least one print head is kept in an appropriate wet state and the quality of printing is enhanced. Moreover, a top surface of the ink inside the at least one inkpot can be controlled to be higher than the at least one print head, so the pneumatic ink-jet system can be applied in a large format inkjet printer.

Other objectives, advantages and novel features of the invention will become more apparent from the following detailed description when taken in conjunction with the accompanying drawings.

DETAILED DESCRIPTION OF THE INVENTION

Figure 1:
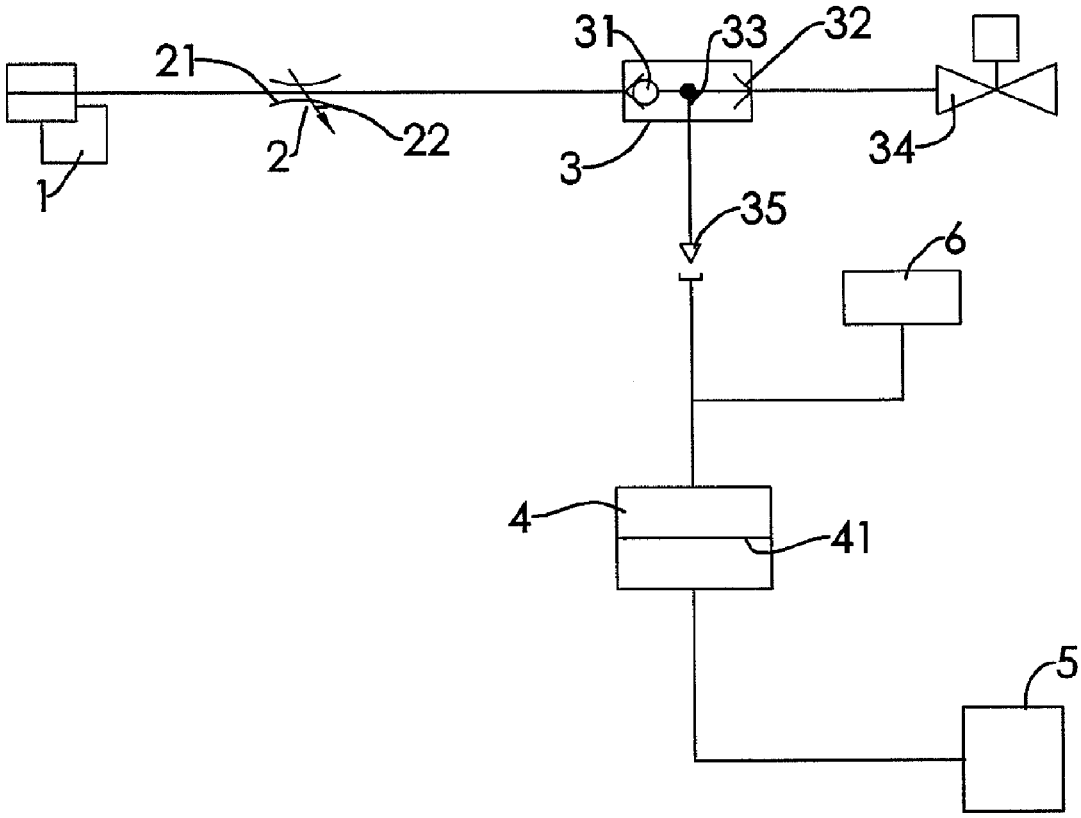
FIG. 1 is a functional block diagram of a pneumatic ink-jet system in accordance with the present invention.
Figure 2:
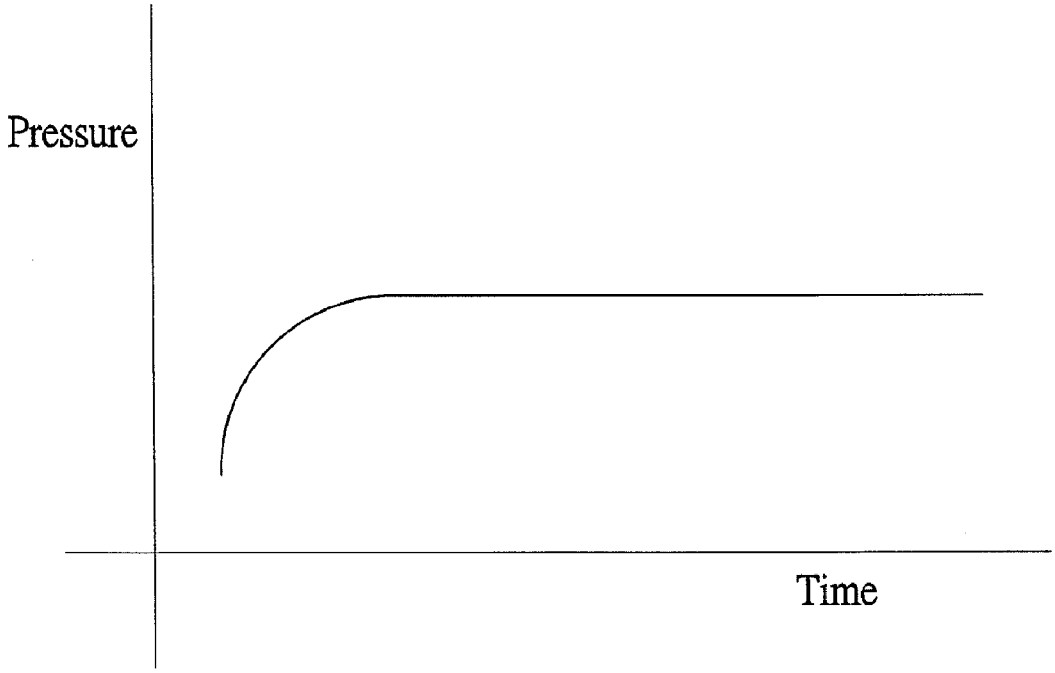
FIG. 2 is a pressure to time diagram of the pneumatic ink-jet system in FIG. 1.

With reference to FIG. 1, a pneumatic ink-jet system in accordance with the present invention is applied in an inkjet printer and comprises a pneumatic source (1), an airflow controller (2), a negative pressure generator (3), a releasing valve (34), an air valve (35), at least one inkpot (4), at least one print head (5) and a pressure meter (6).

The pneumatic source (1) is used to pressurize airflow and may be an air pump.

The airflow controller (2) is connected to the pneumatic source (1), is used to adjust flow rate of the airflow that flows through the airflow controller (2), may be an adjusting valve and has an input end (21) and an output end (22). The input end (21) is connected to the pneumatic source (1).

The negative pressure generator (3) has an inlet (31), an outlet (32) and a negative pressure pipe (33).

The inlet (31) is connected to the output end (22) of the airflow controller (2) to allow the airflow to enter the negative pressure generator (3).

The outlet (32) is connected to the inlet (31) via a direct pipe, communicates with the inlet (31) of the negative pressure generator (3), is narrower than the inlet (31) and selectively opens to exhaust the airflow out of the negative pressure generator (3).

The negative pressure pipe (33) is perpendicularly connected to the direct pipe between the inlet (31) and the outlet (32) of the negative pressure generator (3) and communicates with the inlet (31) and outlet (32) of the negative pressure generator (3). According to the Bernoulli's Theory, when the flow rate of the airflow is getting higher, the air pressure of the airflow is getting lower. Because the difference of pressure generated by the difference of flow rate, the air inside the negative pressure pipe (33) will be socked toward the direct pipe while the airflow flows through the direct pipe and out of the outlet (32) with a speed. So, negative pressure can be selectively generated inside the negative pressure pipe (33) when the outlet (32) is open.

The releasing valve (34) is connected to the outlet (32) of the negative pressure generator (3) to control the airflow and is closed and opened electronically.

The air valve (35) is connected to the negative pressure pipe (33) of the negative pressure generator (3) and is closed and opened electronically.

The at least one inkpot (4) is connected to the air valve (35), communicates with the negative pressure pipe (33) of the negative pressure generator (3) and is loaded with ink (41).

The at least one print head (5) is connected to the at least one inkpot (4) to jet the ink (41) when the inkjet printer prints.

The pressure meter (6) is connected detachably between the at least one inkpot (4) and the negative pressure pipe (33) of the negative pressure generator (3) to detect the air pressure, such that users may adjust the pressure inside the at least one inkpot (4).

Figure 3:
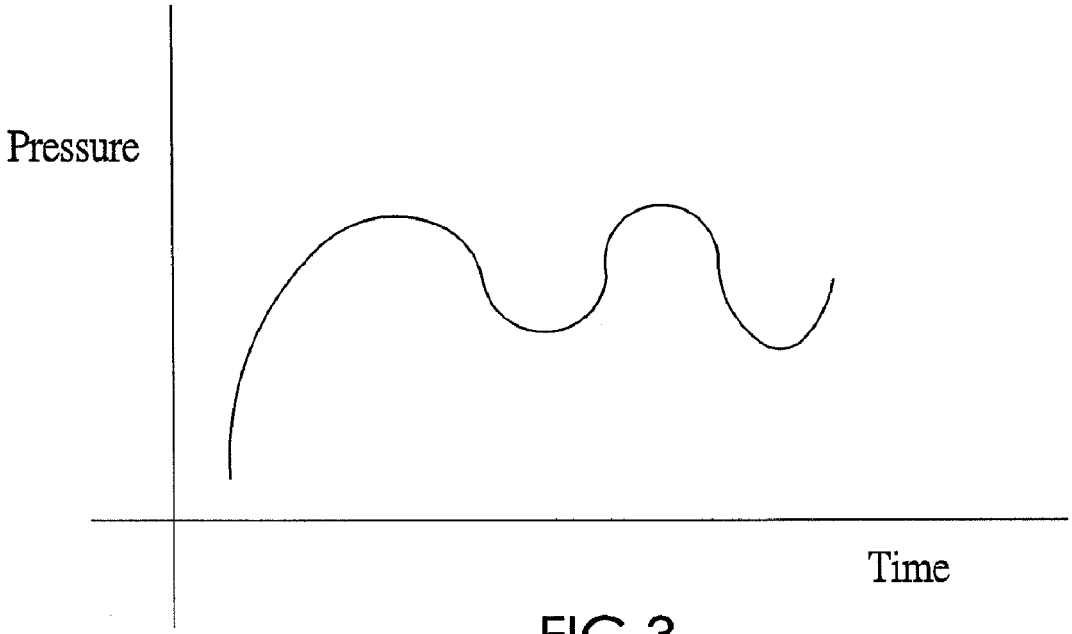
FIG.3 PRIOR ART
FIG. 3 is a pressure to time diagram of a conventional pneumatic ink-jet system in accordance with the prior art.

While an appropriate flow rate of the airflow is set up at the beginning, a related negative pressure will be generated inside the at least one inkpot (4) first and draw out the air inside the at least one inkpot (4) to flow out from the outlet (32) of the negative pressure generator (3). After that, closing the outlet (32) of the negative pressure generator (3) directly drives the airflow to flow into the at least one inkpot (4) from the negative pressure pipe (33) and presses the ink (41) into the at least one print head. Then, closing the air valve (35) or the negative pressure pipe (33) cuts off the airflow to hold the ink (41) in the at least one print head (5) and keep the at least one print head (5) in an appropriate wet state. With further reference to FIG. 3, because the flow rate of the airflow is stable, so the pressure can be maintained stable too, such that the quality of printing is enhanced.

Moreover, a top surface of the ink (41) inside the inkpot at least one (4) can be controlled to be higher than the at least one print head (5) by adjusting the pressure, such that allows the pneumatic ink-jet system to be applied in a large format inkjet printer.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A pneumatic ink-jet system comprising:

a pneumatic source;

an airflow controller being connected to the pneumatic source and having an input end being connected to the pneumatic source; and an output end;

a negative pressure generator having an inlet being connected to the output end of the airflow controller;

an outlet being connected to the inlet via a direct pipe and communicating with the inlet of the negative pressure generator; and a negative pressure pipe being perpendicularly connected to the direct pipe between the inlet and the outlet and communicating with the inlet;

at least one inkpot being connected to and communicating with the negative pressure pipe of the negative pressure generator and is loaded with ink; and at least one print head being connected to the at least one inkpot.

2. The pneumatic ink-jet system as claimed in claim 1 further comprising a releasing valve being connected to the outlet of the negative pressure generator.

3. The pneumatic ink-jet system as claimed in claim 2 further comprising an air valve being connected to the negative pressure pipe of the negative pressure generator.

4. The pneumatic ink-jet system as claimed in claim 3 further comprising a pressure meter being connected between the at least one inkpot and the negative pressure pipe of the negative pressure generator.

5. The pneumatic ink-jet system as claimed in claim 3, wherein the airflow controller is an adjusting valve.

6. The pneumatic ink-jet system as claimed in claim 2 further comprising a pressure meter being connected between the at least one inkpot and the negative pressure pipe of the negative pressure generator.

7. The pneumatic ink-jet system as claimed in claim 2, wherein the airflow controller is an adjusting valve.

8. The pneumatic ink-jet system as claimed in claim 1 further comprising an air valve being connected to the negative pressure pipe of the negative pressure generator.

9. The pneumatic ink-jet system as claimed in claim 8 further comprising a pressure meter being connected between the at least one inkpot and the negative pressure pipe of the negative pressure generator.

10. The pneumatic ink-jet system as claimed in claim 8, wherein the airflow controller is an adjusting valve.

11. The pneumatic ink-jet system as claimed in claim 1 further comprising a pressure meter being connected between the at least one inkpot and the negative pressure pipe of the negative pressure generator.

12. The pneumatic ink-jet system as claimed in claim 1, wherein the airflow controller is an adjusting valve.

* * * * *